United States Patent [19]

Sopher

[11] 4,191,864

[45] Mar. 4, 1980

[54] METHOD AND APPARATUS FOR MEASURING ATTACK AND RELEASE TIMES OF HEARING AIDS

[75] Inventor: Joshua E. Sopher, Berkeley, Calif.

[73] Assignee: American Hospital Supply Corporation, Evanston, Ill.

[21] Appl. No.: 936,735

[22] Filed: Aug. 25, 1978

[51] Int. Cl.[2] ..... H04R 29/00

[52] U.S. Cl. ..... 179/175.1 A; 179/107 R

[58] Field of Search ..... 179/175.1 A, 175.2 R, 179/175.2 C, 175, 107 R, 107 E, 107 FD

[56] References Cited

U.S. PATENT DOCUMENTS

| | | | |
|---|---|---|---|
| 3,692,959 | 9/1972 | Lamp | 179/175.1 A |
| 3,922,506 | 11/1975 | Frye | 179/175.1 A |
| 4,049,930 | 9/1977 | Fletcher et al. | 179/175.1 A |
| 4,065,647 | 12/1977 | Frye et al. | 179/175.1 A |

OTHER PUBLICATIONS

"Computerized Hearing Aid Testing", by Frye, *Hearing Instruments* for Feb. 1977, pp. 14 and 29.

*Primary Examiner*—Thomas A. Robinson

*Attorney, Agent, or Firm*—Emrich, Root, O'Keeffe & Lee

[57] ABSTRACT

At the option of an operator, the attack or release time of a hearing aid is automatically measured, and the measurement displayed in milliseconds on a digital readout. A test tone signal of constant frequency is successively cycled between relatively low and high power levels. During the first cycle of the test signal a sample is taken and stored which is representative of the steady state response of the hearing aid under test; and during the second cycle a measurement is automatically made of the time required for the output of the hearing aid to settle to within a predetermined recovery range about the stored sample signal.

22 Claims, 9 Drawing Figures

BLOCK DIAGRAM OF THE MEASURING CIRCUIT

METHOD AND APPARATUS FOR MEASURING ATTACK AND RELEASE TIMES OF HEARING AIDS

BACKGROUND AND SUMMARY

The present invention relates to measuring the response time (i.e. either the attack or the release time) of acoustical devices in general; and more particularly, it relates to a method and apparatus for automatically measuring the time period of transient response in an electronic circuit having feedback control to maintain its output amplitude within desired limits without clipping. Thus, the system may be used to measure response times for hearing aids, earphones, automatic gain or volume control circuits or compression circuits.

By way of example only, the attack time and release time of a hearing aid having automatic gain control are well-defined performance parameters of hearing aids; and specifications have been established in the industry for measuring attack time and release time. Briefly, a tone signal of constant frequency (for example, 2000 Hz) and having an acoustical power level of 55 dB Sound Pressure Level (SPL) is increased to 80 dB SPL; and the attack time is defined as the amount of time it takes the hearing aid to return to and stay within a range of ±2 dB of its quiescent or "steady state" response at the 80 dB SPL input level.

In measuring the release time, the input signal is abruptly changed from the 80 dB SPL level down to the 55 dB SPL level; and the release time is defined as the amount of time it takes the hearing aid to maintain a value within ±2 dB of its steady state response at the 55 dB SPL input level. As indicated above, these measurements are well defined in the industry, and the attack and release times are accepted as performance criteria for hearing aids. The present invention has much broader application, however, as persons skilled in the art will appreciate; and, for example, any one or more of the above levels, times, or frequencies can easily be modified without limiting the invention.

As used herein the input acoustical signal, whether at the 55 or 80 dB SPL levels (or other level) is referred to as the "test tone". The output signal level of the device under test in response to an input test tone and after all transient responses have subsided is referred to as the "quiescent" or "steady state" response of the device. The ±2 dB range above and below the steady state response within which the output level of the unit must settle in measuring recovery times (whether attack or release) is referred to as the "recovery range". The upper limit (steady state response plus 2 dB) of the recovery range is called the "upper threshold"; and the lower limit (steady state response minus 2 dB) is called the "lower threshold".

Currently, attack and release times of hearing aids are usually measured manually. This method is time consuming and subject to the error of subjective measurement by a skilled operator. Further, it requires the use of expensive equipment, such as an oscilloscope with storage capability or an oscilloscope capable of taking a photograph of the time-varying response. Typically, after the scope controls are set up by the operator and adjusted to obtain the optimum sensitivity and time base display scales, and to insure proper triggering of the scope, measurements of the steady state response representing the output of the hearing aid to be tested are made at first and second levels. Voltages corresponding to ±2 dB of the steady state levels then have to be calculated from the measurements; and the hearing aid is subjected to a second input signal which changes from one of the levels to the other during which the actual time measurements for attack and release for the calculated steady state levels is made.

These measurements are made visually on the oscilloscope response, based upon the ±2 dB response levels calculated for the first test measurement. It normally takes two or three attempts before obtaining proper settings of the oscilloscope display for obtaining an accurate measurement. The response level normally changes from device to device, so the complete set up and initial calculation of recovery range may have to be made for each device. Obviously, the time required of a skilled operator to perform this test may be substantial.

Further, it may be desirable to measure attack and release times for different input signal levels; and to do this, the oscilloscope sensitivity ranges have to be changed. For low level signals, the oscilloscope may not be sensitive enough to provide a sufficiently large display to permit good resolution. This may result in reduced accuracy of measurement.

The measurement of attack and release times through the visual observation of an operator may be further complicated if the response of the unit being tested oscillates through the calculated recovery range. For example, the unit may exhibit a damped oscillation or "ringing" effect. In the case of measuring release time, the envelope of the response may undershoot the recovery range and even overshoot it thereafter. The operator must then determine which of the peaks and valleys of the oscillating response envelope are to be taken for measurement purposes.

The present invention is designed to perform attack and release time measurements for hearing aids with automatic gain control without the intervention of an operator and without requiring the operator to have any skills whatever in interpreting specific responses. In accordance with the present invention, the desired measurement is displayed in numeric form on a digital display, thereby obviating the need for interpretive measurement.

According to the present invention, a test tone signal of constant frequency is successively cycled between a relatively low power level and a relatively high power level. According to standards for measuring attack and release times of hearing aids with automatic gain control now in effect, these levels are 55 and 80 dB SPL respectively. Thus, the test tone signal generator generates a continuous wave, sinusoidal acoustical signal of 55 dB SPL for two seconds, then abruptly changes the power level to 80 dB SPL for 0.5 seconds, followed by another two second interval of tone at the 55 dB SPL level and finally again increases the level to 80 dB SPL for 0.5 seconds. This signal is coupled through a loudspeaker in a sound chamber in which the hearing aid unit under test is also enclosed. The operator sets a function switch to either the attack time measuring mode or the release time measuring mode. The test tone may be a constant frequency of 2,000 Hz.

Assuming that the release time is being measured, the operator sets the function switch accordingly, and during the first burst of test tone at the 55 dB level, the gain of an input amplifier coupled to the hearing aid is automatically adjusted so that the detection circuitry is operating with the input amplifier in a linear range.

After the gain of the input amplifier has been adjusted and the response of the test unit has settled to a quiescent value, and still during the first burst of test tone at the 55 dB level, the response of the unit under test is measured by a peak detector circuit, and the response is stored in a sample and hold circuit. The output of the sample and hold circuit is used as a reference signal and coupled to a pair of comparators. One of the comparators is set to detect at the upper limit of the recovery range, and the other comparator detects the lower limit of the recovery range. The input signal is also coupled to the signal inputs of the comparators.

After the sample and hold circuit has stored a signal representative of the quiescent response of the unit under test at the 55 dB level, the test tone signal is increased to the 80 dB level; and again, the unit under test is permitted to achieve quiescent operation at the higher level. Following that, the test tone signal abruptly reduces to the 55 dB level, and this commences measurement for the release time by enabling a clock pulse train of predetermined repetition rate (1 millisecond for example) to be generated. The clock pulses are fed to a counter, including three individual BCD counters representative respectively of the units, tens and hundreds positions (in milliseconds) of the measurement. The clock pulses are accumulated in the counter. The outputs of the three counters are fed respectively to three registers, the outputs of which are coupled to digital displays for the three numerical positions of readout. During the measurement, the counters continue to accumulate clock pulses, and the comparator circuits enable the registers to be updated each time the response signal makes an excursion outside of the predetermined recovery range.

As an example, in the case of measuring release time at the start of a measurement when the sound pressure level is decreased, the measured signal will undershoot the lower threshold level of the recovery range. When the response level goes below the lower threshold level, the absence of output from the lower limit comparator permits a missing pulse detector to time out; and the output of the missing pulse detector causes the registers to be updated with current information contained in the counters. The missing pulse detector prevents false updating of the registers by noise. Whenever the response signal exceeds the upper threshold level of the recovery range, each individual tone signal is used to update the registers. Thus, when the response signal settles within the recovery range, the last updated accumulative count stored in the registers is a measure of the time in which it took the response signal to settle within the recovery range, and this becomes the release time for the unit under test.

The circuitry operates in a similar manner for measuring attack time, except that the sample representative of the steady state response is taken during the first burst of test tone signal at the 80 dB level after a quiescent value has been reached; and measurement commences the second time the test tone signal is increased from 55 dB to 80 dB.

With the present invention, a measurement of release time appears within about three seconds after the measurement is initiated by the operator; and an attack time measurement appears within about five seconds after the instrument is placed in the attack measuring mode and the measurement initiated. Further, there is no visual interpretation required on the part of the operator—rather, a simple, easily recorded digital measurement is visually presented to him. The present invention thus eliminates tedious, interpretive measurements, it shortens the time required for measurements, and it increases the accuracy of measurement. The present invention also has high immunity to a burst of acoustic noise.

Other features and advantages of the present invention will be apparent to persons skilled in the art from the following detailed description of a preferred embodiment accompanied by the attached drawing wherein identical reference numerals will refer to like parts in the various views.

THE DRAWING

DETAILED DESCRIPTION

Figure 1:
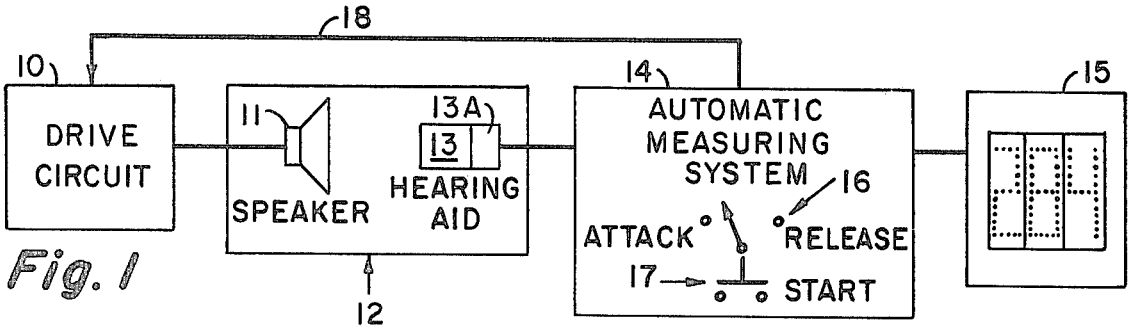
FIG. 1 is a functional block diagram of a system for measuring attack and release times according to the present invention.
Figure 2:
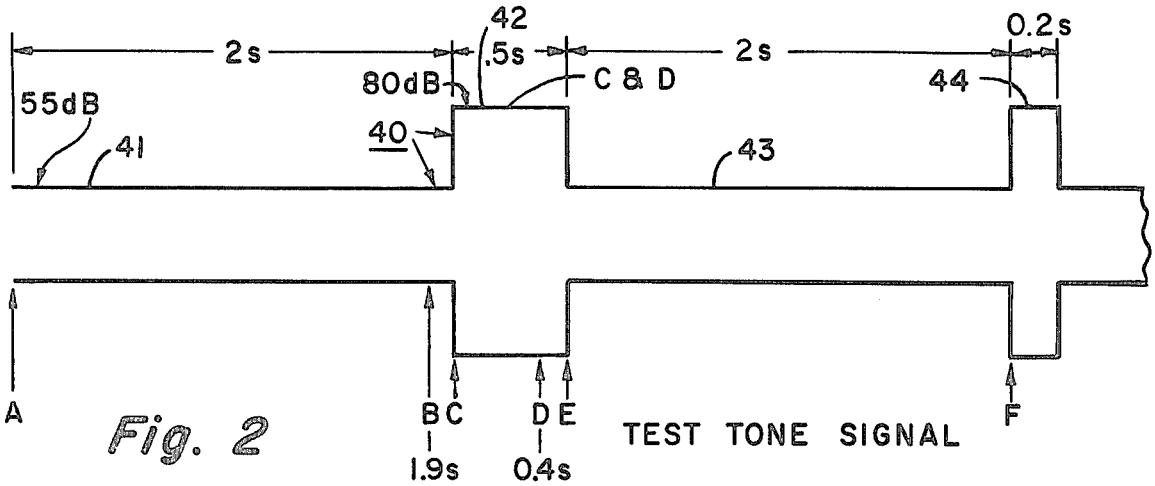
FIG. 2 is an idealized waveform for the test tone signal used in the apparatus of FIG. 1.

Referring to FIG. 1, a drive circuit 10 produces a test tone signal such as that shown in FIG. 2, to be described presently, and feeds it to a loudspeaker 11 placed in a sound pressure chamber generally designated 12. Also enclosed within chamber 12 is a hearing aid 13 under test. The output of the hearing aid 13 is coupled through a conventional coupler and microphone 13A to an automatic measuring system 14, the output of which feeds a digital display 15. The automatic measuring system includes a function switch 16 capable of measuring either the attack time or the release time of the hearing aid under test. It also includes a start switch 17 which, when actuated by the operator, begins a test.

The drive circuit 10 is shown in more detail in FIG. 3, and will be described further below. The sound pressure chamber 12, loudspeaker 11, coupler and microphone 13A, and associated drive amplifier are commercially available in the model HC 2000 "PHONIC EAR" acoustic computer, manufactured by HC Electronics, Inc., of Mill Valley, Calif.

The present invention is intended to be used with other acoustical chambers and loudspeakers, and it may be used to test a wide variety of hearing aids or other circuits with automatic gain control, automatic volume control or compression circuits to measure response times. Briefly, the system operates as follows. Referring to FIG. 1, the operator uses the function select switch 16 to determine whether attack or release time will be measured, and he simply presses the start button 17. This initiates and determines the timing of the test tone signal generator by means of a timing bus 18, and it also actuates the measuring circuitry as will be described. The time measured automatically appears at the end of a test on the digital display 15.

Figure 1A:
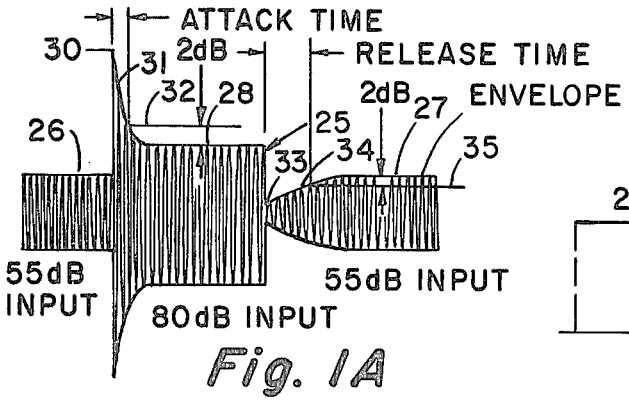
FIGS. 1A and 1B are idealized diagrams of waveforms illustrating outputs of a hearing aid under test for attack and release times.

Turning now to FIG. 1A, the terms "attack time" and "release time" for a hearing aid or other acoustical device having automatic gain control will be defined. A generic term used to cover both attack and release times is simply "recovery" time. In FIG. 1A, there is shown an idealized voltage waveform of a continuous wave or sinusoidal signal of a relatively high frequency as compared with the time scale in FIG. 1A (which is along the abscissa). However, the envelope of the signal is generally designated by reference numeral 25; and it represents the signal which is the output signal of the acoustical device under test.

The device is being subjected to an acoustical test tone signal (for example, from the loudspeaker 11) having two amplitude levels—one being 55 dB SPL, and producing a corresponding steady state response in the device being tested as indicated by the portions 26 and 27 on the envelope 25. When the input level is changed to 80 dB SPL, a steady state response such as that shown by the portion 28 in FIG. 1A results. By switching the input abruptly from the relatively low input level to the relatively high input level, due to the automatic gain control circuitry in the acoustical evice, the device responds abruptly and overshoots its corresponding steady state response 28 by the peak shown at 30, and then, as is the theoretical or ideal case, the response of the device decays exponentially according to the line 31 to the steady state response at 28.

The attack time, as indicated in the drawing is the time it takes the device to recover from the peak 30 to a level designated 32 which is defined as being 2 dB greater than the steady state response 28 for that level of input.

Similarly, when the input sound pressure level is reduced from the relatively high level producing the response at 28 to the relatively low level producing the response at 27, the output of the device under test will abruptly decrease to the level 33, and then gradually recover according to the exponential curve 34. The release time is defined as the time it takes the device to recover from the change in input at 33 to the level 35 which is 2 dB lower than the steady state response 27.

Figure 1B:
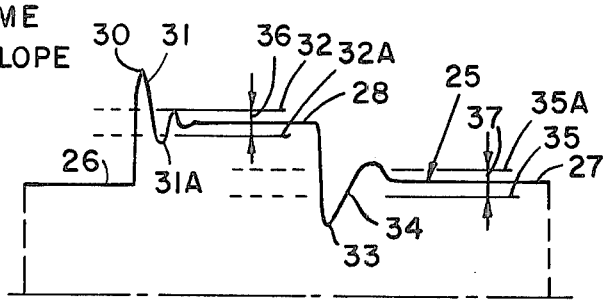

As indicated above, the waveform of FIG. 1A is idealized, and it is more realistic to expect the device to have a ringing effect, such as that shown in FIG. 1B, wherein only the envelope of the response waveform is shown; and it is again designated 25. Corresponding reference numerals are shown in FIG. 1B relating it to the portions discussed above in connection with FIG. 1A. However, some of the waveform has been idealized and exaggerated for illustration purposes. In this example, for measuring the attack time of the device, assuming that the steady state response at the higher input level is that designated at 28, the decay time may reduce to a point at 31A which is beneath a level 32A which is 2 dB below the steady state level 28. Thus, a "recovery range" is defined as a range of amplitudes ±2 dB from the steady state response 28. In FIG. 1B, the recovery range for measuring attack time is illustrated by the vertical arrow 36. The recovery range includes an "upper threshold level" defined by the line 32, and a "lower threshold level" defined by the line 32A.

Similarly, a recovery range for measuring release time is indicated by an arrow 37, and it is defined by an upper threshold level 35A and a lower threshold level 35 (which, in this example, are respectively 2 dB higher and 2 dB lower than the steady state response level 27). To repeat, the curve 25 is the envelope of a higher frequency electrical signal which is the response or output signal of the device under test (designated 13 in FIG. 1) which responds to a test tone acoustical signal produced by the loudspeaker 11, the amplitude of which is cycled between a relatively low sound level and a relatively high sound level. These acoustical levels, in the example, are 55 and 80 dB SPL respectively.

Referring now to FIG. 2, there is shown, again in idealized form, the sequence of signals (which collectively comprise the test tone signal) produced by the drive circuit 10. For convenience of relating the timing of the test tone signal to the circuitry of FIG. 4 which establishes the time base, on the time axis of FIG. 2 there are identified six separate times, designated respectively A–F. Referring then to FIG. 2, the test tone signal is generally designated by reference numeral 40, and it comprises a pulsed sinusoidal signal of a constant frequency of 2,000 Hz. The envelope of the test tone signal includes a first portion designated 41 which is sufficient in magnitude to generate a 55 dB SPL level in the sound pressure chamber 12. This lasts for two seconds, spanning time period A–C. Following that, for a period of 0.5 seconds, the amplitude is increased as at 42 to generate a sound pressure signal of 80 dB SPL. This terminates at the time point E. This sequence is repeated for a second time, comprising the portion 43 which generates the sound pressure level of 55 dB SPL, again for two seconds, and finally the portion 44 lasting for 0.2 seconds which again generates the 80 dB SPL level in the chamber.

Thus, the test tone signal of FIG. 2 is a constant frequency tone signal which is successively cycled between a relatively low (portion 41, 43) and a relatively high acoustical power level (portions 42, 44). The time lengths of the relatively low and relatively high portions are such that the duration should be approximately five times the duration of the longest expected release time and attack time respectively. In other words, the duration of the portions 41, 43 are approximately five times as long as the longest release time expected to be measured; and the duration of the portions 42, 44 are approximately five times as long as the longest attack time expected to be measured. The reason for this is to insure that the response of the test unit has reached a steady state value before a sample is taken representative of its quiescent steady state response.

Still referring to FIG. 2, the time B occurs 0.1 seconds prior to time C; and time D occurs 0.1 seconds prior to time E (which indicates the switch from the relatively high power level to the relatively low power level).

Before discussing the detailed operation of the drive circuit 10 in the automatic measuring system 14, it is believed that the present invention will be better understood if the overall system functioning is described in relation to FIG. 2. Referring first to the measurement of release time, the function switch 16 is placed in the "release" mode, and the start button 17 is pushed. It is expected that the longest release time to be measured would be about 400 milliseconds, so the 55 dB SPL level is applied for approximately two seconds to the test unit, beginning at time A. After the response of the unit being tested has settled to a steady state value, a sample of its response is taken during the time B–C in FIG. 2. This sample is then stored. The amplitude of the test tone is then increased to the level at 42; and again, after a steady state level has been attained, it is abruptly changed at time E to the lower input level designated 43. It is during this time (beginning at time E) during which release time is measured. Since the longest release time is less than 400 milliseconds, a measurement is produced on the digital readout 15 in less than three seconds from the time the start button is pushed.

For measuring attack time, the same sequence of test tone signal is generated, and the function switch is set to the "attack" position. Again, the start switch 17 is actuated, and the test tone signal of FIG. 2 is applied to the unit under test. Nothing is done by the measuring circuit during the portion 41; but during the portion D–E (which is the last 100 milliseconds of the first burst of relatively high level input), a sample is taken of the steady state response of the unit under test, and again it is stored. Next, the relatively low level input is applied at 43, and after the unit has achieved a steady state operation, the input is abruptly increased to the higher level 44 at time F. This commences measurement of the attack time. A result is produced within five seconds of the time at which the start button is actuated.

During each of the measurements, as will be more fully explained below, the initial sample of steady state response is used as a basis of measurement about which the recovery range is defined. In other words, for measuring attack time, referring back to FIG. 1B, during the first burst of higher input level 42, a measurement is made and stored which is representative of the steady state response 28 of the unit being tested. A pair of comparators, taking the level 28 as a reference, then define the recovery range 36 by establishing the upper threshold 32 and the lower threshold 32A. This recovery range will therefore be adjusted for the steady state response of each individual unit under test without action by the operator; and during the second burst of high level input, the automatic measuring system will automatically measure the time it takes the unit being tested to settle permanently within the recovery range 36, and present a visual display of the measurement result.

Figure 4:
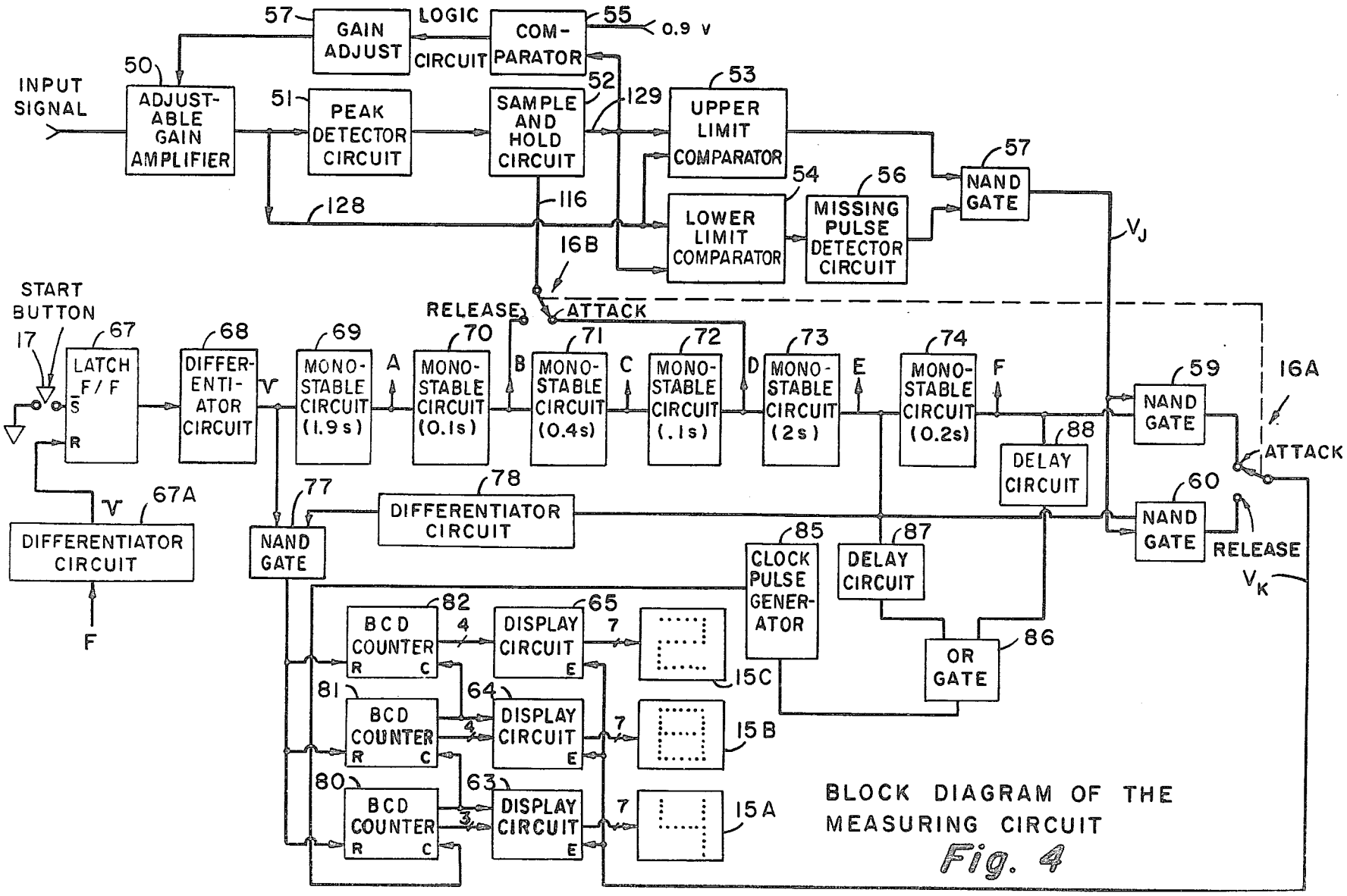
FIG. 4 is a functional block diagram of the automatic measuring system of the system of FIG. 1.

Turning now to FIG. 4, the output signal from the unit under test is fed to an adjustable gain amplifier 50, the output of which feeds a peak detector circuit 51. The output of the peak detector circuit is coupled to a sample and hold circuit 52. The output of the sample and hold circuit 52 is fed to an upper limit comparator 53 and a lower limit comparator 54, as well as to a comparator 55. The upper limit comparator 53 and lower limit comparator 54 define respectively the upper and lower limits of the recovery range; and they each also receive the output signal from the adjustable gain amplifier 50. The comparator 55 receives as a reference input, a fixed reference voltage which in this case is 0.9 volts. The output of the comparator 55 is fed to gain adjust logic circuitry 57 which is used to adjust the gain of the amplifier 50, in a manner to be discussed in more detail in connection with FIG. 5. Briefly, however the gain adjust logic circuitry is used to adjust the gain of the amplifier 50 to one of three predetermined gain values, and maintain it while the measurement is being made, so that the amplifier is always operating in a linear range depending upon the magnitude of the input voltage. This obviates the need for gain adjustment by an operator, yet permits the system to operate over a wide range of signal and to take measurements on units having a wide range of gain.

The output of the lower limit comparator 54 is coupled to a missing pulse detector circuit 56; and the outputs of the upper limit comparator 53 and the missing pulse detector 56 are connected respectively to the inputs of a NAND gate 57, the output of which feeds first and second NAND gates 59, 60.

The circuitry comprising the upper and lower limit comparators and the missing pulse detector will be described in more detail in connection with FIG. 6; but briefly, the output of the NAND gate 57 comprises an ENABLE or UPDATE signal for updating the display registers, as will be discussed presently. The ENABLE signal may be generated by the upper limit comparator for the case where the actual response signal is above the upper limit of the recovery range (designated 32 and 35A respectively in FIG. 1B for measuring the attack and the release times), and the ENABLE or UPDATE signal is generated by the missing pulse detector circuit 56 after the lower limit comparator 54 determines that the response is beneath the lower threshold of the recovery range (designated 32A and 35 respectively in FIG. 1B for the recovery time and release time measurements).

The function switch 16 is a single-pole, double-throw switch having a first deck 16A and a second deck 16B. In the "attack" position, the switch deck 16A couples the output of the NAND gate 59 to the Enable input of the three display circuits designated 63, 64 and 65. These circuits each include a register for storing the output of an associated counter, a decoder for decoding the output of the register, and LED drivers, all of which are commercially available. The three registers are associated respectively with the units, tens and hundreds positions of the output reading. The outputs of the drivers are coupled respectively to the individual LED display units designated respectively 15A, 15B and 15C which collectively form the LED display 15 of FIG. 1. The decoder converts the binary count into a code which illuminates the appropriate elements of the display to produce the corresponding decimal number. The driver provides the required power to illuminate the LEDS.

Turning now to the left center portion of FIG. 4, the start button 17, when actuated, couples a signal to the set input of a latch flip-flop 67, the output of which is connected to the input of a differentiator circuit 68. The output of the differentiator circuit is coupled to a series of monostable circuits for generating a chain of sequential time pulses. There are six such monostable circuits and they are designated 69–74 respectively. Each of the monostable circuits in the timing chain generates an output signal which commences as soon as the associated monostable circuit is triggered, and the output pulse lasts for the amount of time indicated in seconds in the associated block. For example, the monostable circuit 69 generates a pulse as soon as it is triggered by the monostable 68, and that pulse lasts for 1.9 seconds. Each of the monostable circuits 69–74 is triggered by a negative-going edge, and each generates a positive pulse. Hence, each circuit is triggered by the trailing edge of the output of the preceding circuit to produce a series of sequential pulses that establish the required timing chain.

The monostable circuit 68 generates a negative pulse, so it acts as a delay prior to triggering the first monostable 69 in the timing chain. The functions of the latch flip-flop 67 are to prevent re-actuation of the timing chain during a measurement and isolate against contact bounce of the switch 17.

The outputs of the monostable circuits in the timing chain are designated further by letters A–F; and these correspond to the times designated A–F on the time axis of FIG. 2. That is, the test tone begins at time A, the sample for a release measurement is taken between times B and C. The higher level burst begins at time C, the sample for an attack measurement is taken between times D and E, and so on. Flip-flop 67 is reset via differentiator circuit 67A by a signal F from monostable circuit 74, after the completion of a sample and measure cycle.

The output of the monostable circuit 68 is fed to one input of a NAND gate 77; and the other input of the NAND gate 77 is received through a differentiator 78 from the output of monostable circuit 73. The output of the NAND gate 77 is connected to the reset inputs of three binary coded decimal (BCD) counters, designated respectively 80, 81 and 82. Each of the BCD counters has four output leads, and these are connected respectively to the registers of display circuits 63–65. The carry output of the counter 80 is coupled to the clock input of the counter 81, and the carry output of the counter 81 is coupled to the clock input of the counter 32.

The clock input of the counter 80 is received from a clock pulse generator 85 which is enabled by means of the output signal from an OR gate 86. This signal is sometimes referred to as the "initiation" signal because it starts the time measuring circuit comprising the clock pulse generator, counters, and registers. The time measurement is completed with the last "ENABLE" signal from one of the NAND gates 59 or 60. The two inputs of the OR gate 86 are received respectively from delay circuits 87, 88 which, in turn, are actuated by the output signals from the monostables 73, 74 in the timing chain, representative respectively of the time signals E and F on FIG. 2. It will be observed that these times are associated respectively with the beginning of the measurement of release time and attack time during a test. The delay circuits 87, 88 comprise delays of one and two milliseconds, respectively, and they compensate for delay in the loudspeaker 11. In other words, the timing for the test tone signal of FIG. 2 is established, as indicated in FIG. 1, from the automatic measuring system 14. However, there is a delay interposed in the measurement between the generation of the electrical test tone signal by the generator 10 and the creation of the corresponding sound pressure wave at the output of the microphone 11. It is this delay in response for which the circuits 87, 88 compensate.

Figure 3:
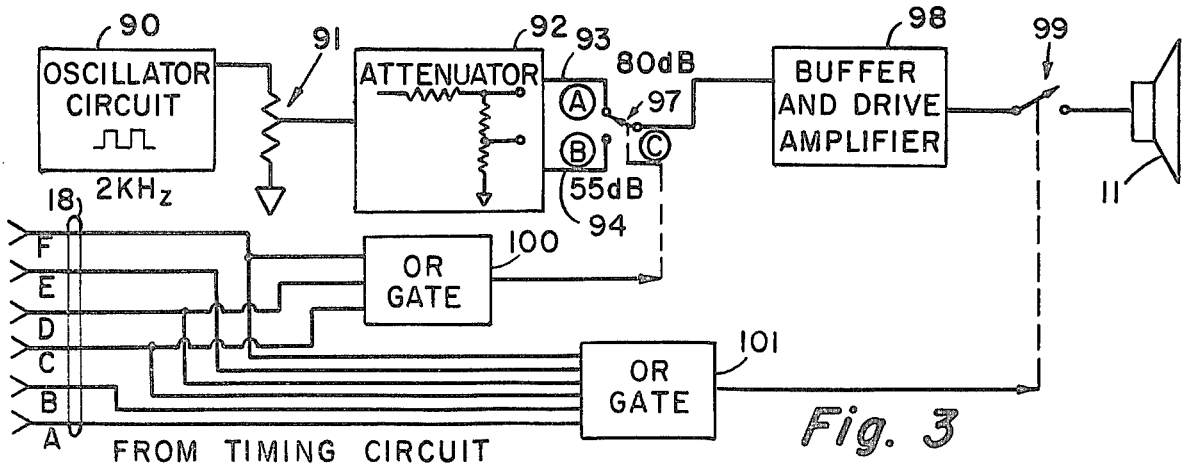
FIG. 3 is a combined functional block and logic level diagram of the drive circuit of the apparatus of FIG. 1.

Turning now to the drive circuit 10, as seen in FIG. 3, an oscillator circuit 90 generates a sinusoidal signal (having a frequency of 2 KHz in the illustrated embodiment). The output of the oscillator 90 is fed through a variable resistor 91 to an attenuator 92 having two output leads designated 93 and 94 respectively. These leads carry signal levels that will generate corresponding sound pressure levels in the chamber 12 of 80 dB SPL and 55 dB SPL respectively. The leads 93, 94 are connected to two inputs of an analog switch diagrammatically represented at 97, the output of which is coupled to the input of a buffer and drive amplifier 98. The output of the amplifier 98 is coupled through another analog switch 99 and thence to the loudspeaker 11 in the chamber. The switch 97 is controlled by the output of an OR gate 100. When the output of the OR gate 100 is a logic 1, the switch 97 conducts between terminals A and C, coupling the signal from lead 93 to the amplifier 98 (to generate the sound pressure wave at the higher level). When the output of OR gate 100 is a 0, the switch conducts between terminals B and C to generate the lower level sound wave. The OR gate 100 receives three inputs; and these are the ones designated by time points C, D and F in the timing chain of FIG. 4, and, as can be seen from an observation of FIG. 2, the test tone signal is at the higher level at the beginning of each of the times C, D and F. The first burst of higher level input is continuous from times C through E.

The switch 99 is controlled by the output of an OR gate 101, which has six inputs along previously described bus 18 and comprising all of the time points A–F of FIG. 4. The function of the OR gate 101 is to isolate the loudspeaker from the oscillator except during the generation of a test tone signal. This allows the loudspeaker to be shared with other measuring apparatus, if desired.

Figure 5:
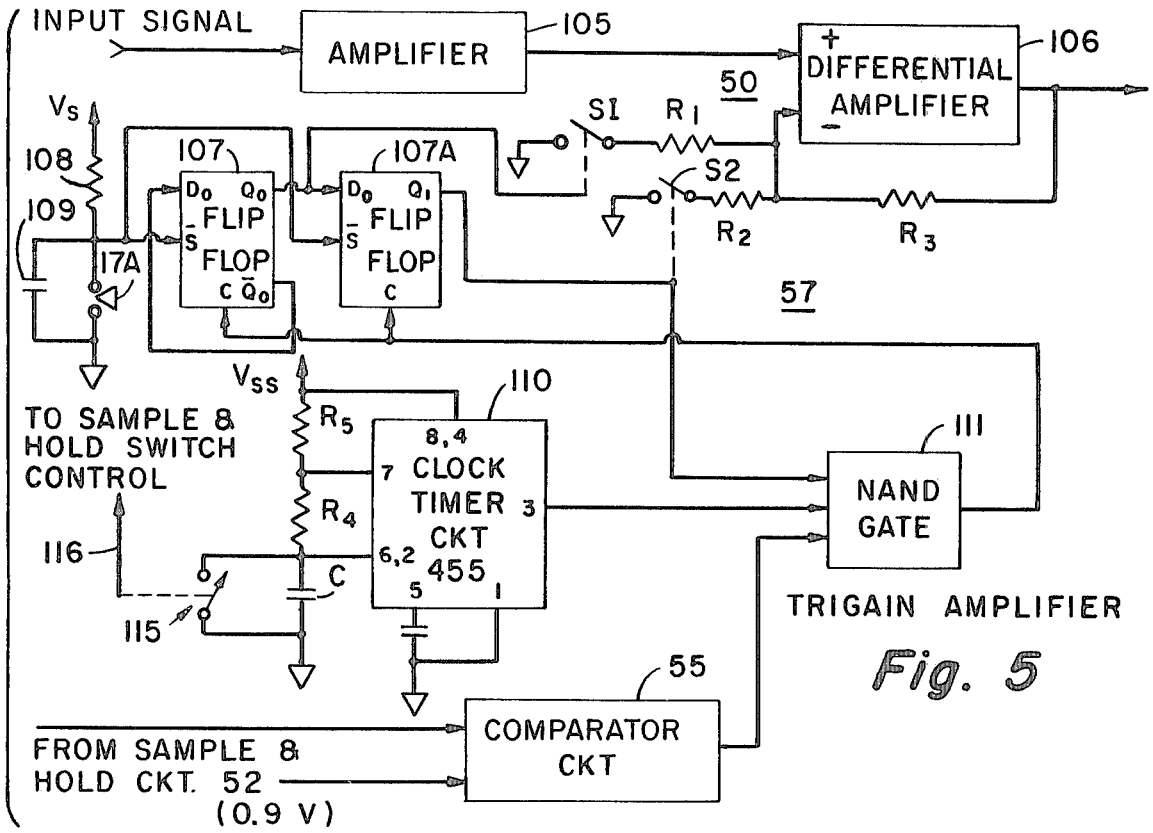
FIG. 5 is a circuit diagram, partly in functional block form, of the automatic gain selection amplifier of FIG. 4.

Referring now to FIG. 5, the circuitry associated with the adjustable gain amplifier 50 will now be discussed. The input signal is coupled through a first fixed gain amplifier 105 to the positive input of a differential amplifier 106. It is the output of the differential amplifier 106 which is coupled to the peak detector circuit 51 of FIG. 4. The negative input of the differential amplifier 106 is connected through a semiconductor switch S1 to ground, and to a second resistor R2, the other terminal of which is connected to a semiconductor switch S2 having its second terminal grounded, and to a feedback resistor R3. The switches S1 and S2 are controlled respectively by the $Q_0$ and $Q_1$ outputs of a counter circuit comprising two D-type flip flops 107 and 107A. The set inputs of the flip flops are connected to the junction between a resistor 108 (the other terminal of which is connected to a positive power supply) and a second deck of the start switch designated 17A which is connected across the capacitor 109. When the start switch is actuated, the counter is set. A timer circuit 110 has its output connected to one input of a NAND gate 111, the output of which is connected to the clock inputs of the flip flops.

The timer circuit 110 may be a commercially available 455 timer, sold by a number of manufacturers, and when connected according to the pin arrangement indicated in the drawing, it acts as a clock generator to generate an output signal which is a train of periodic pulses to the NAND gate 111. The repetition rate of the output signal from the timer circuit 110 is determined by resistors R4 and R5 and a capacitor C, and controlled by the signal from the wiper arm of the deck 16B of the function switch, which also is fed to the sample and hold circuit of FIG. 4. The semiconductor switch 115 is an open circuit during the sampling period (see time points B and D respectively in FIG. 2). This initiates operation of the timer circuit 110, providing clock pulses with a period of 20 ms. (sufficiently long for a sample to be taken), and allowing at least three samples to be taken during the sampling period.

As will be understood from subsequent description, the output of the timer circuit 110 clocks the counter circuit to sequentially adjust the gain of the amplifier. The output of the timer circuit 110 is fed to a second input of the NAND gate 111. A third input of the NAND gate 111 is received from the previously mentioned comparator circuit 55 (FIG. 4) which generates a logic 1 when the output of the sample and hold circuit is less than the reference voltage, which in this case is 6% of the supply voltage. When the output of the comparator circuit is a logic 1, the NAND gate 111 is enabled to permit the output of the timer circuit 110 to clock the counter circuit to its next state. The $Q_1$ output of the counter circuit 107 is fed to the NAND gate 111. This inhibits further triggering of the clock circuit beyond the third count. The counter comprising the flip flops 107, 107A changes state with the positive-going edge of the clock input. The first stage divides by two. Its input $Q_0$ is fed to the input of the second stage, which uses the same clock. Accordingly, if the counter starts with both outputs at logic 1, the first clock pulse produces $Q_0=0$, $Q_1=1$, and the second clock pulse produces $Q_0=1$, $Q_1=0$.

The gain of the operational amplifier 106 is dependent upon whether resistors R1 and R2 are in circuit or out of circuit. When the two switches S1 and S2 are open and the resistors R1 and R2 are out of the feedback circuit of the operational amplifier, the gain of the amplifier is at its lowest value. When switch S1 is closed the register R1 is in circuit, the gain increases by a factor of ten, and when switch S2 closes (and S1 is open) and resistor R2 is in circuit, the gain increases by a factor of 100.

The operation of the variable gain circuitry is s follows. When the start button is pushed, the switch 17A is closed to set the counter circuit so that both outputs $Q_0$, $Q_1$ are 1. When both outputs are 1, the semiconductor switches S1, S2 are both open, thereby rendering the gain of the operational amplifier 106 at its lowest value of unity gain. If the output of the sample and hold circuit is less than the reference input to the comparator circuit 55, the NAND gate 111 is enabled, and a first clock pulse from the timer circuit 110 clocks the counter circuit 107 so that its $Q_0$ output goes to a 0, thereby closing switch S1 and increasing the gain of the amplifier 106 by a factor of 10. This pulse occurs 20 ms. after the start of the sampling period allowing for the acquisition time of the sample and hold circuit. If, prior to the next clock pulse from the timer circuit 110, the output of the sample and hold circuit is greater than the reference voltage for the comparator circuit 55, no further clock pulses are permitted to be transmitted through the NAND gate 111. If this condition does not prevail, however, then the next clock pulse (20 ms later) will cause the switch S2 to open and S1 to close; and the gain of the amplifier 106 will be still further increased. The $Q_1$ output of the counter circuit 107 will also inhibit further transmission of clock pulses by the NAND gate 111. At the end of the sampling period, the timing signal along line 116 will cause the switch 115 to conduct, thereby shorting out capacitor C and inhibiting further generation of pulses by the timer circuit.

Figure 6:
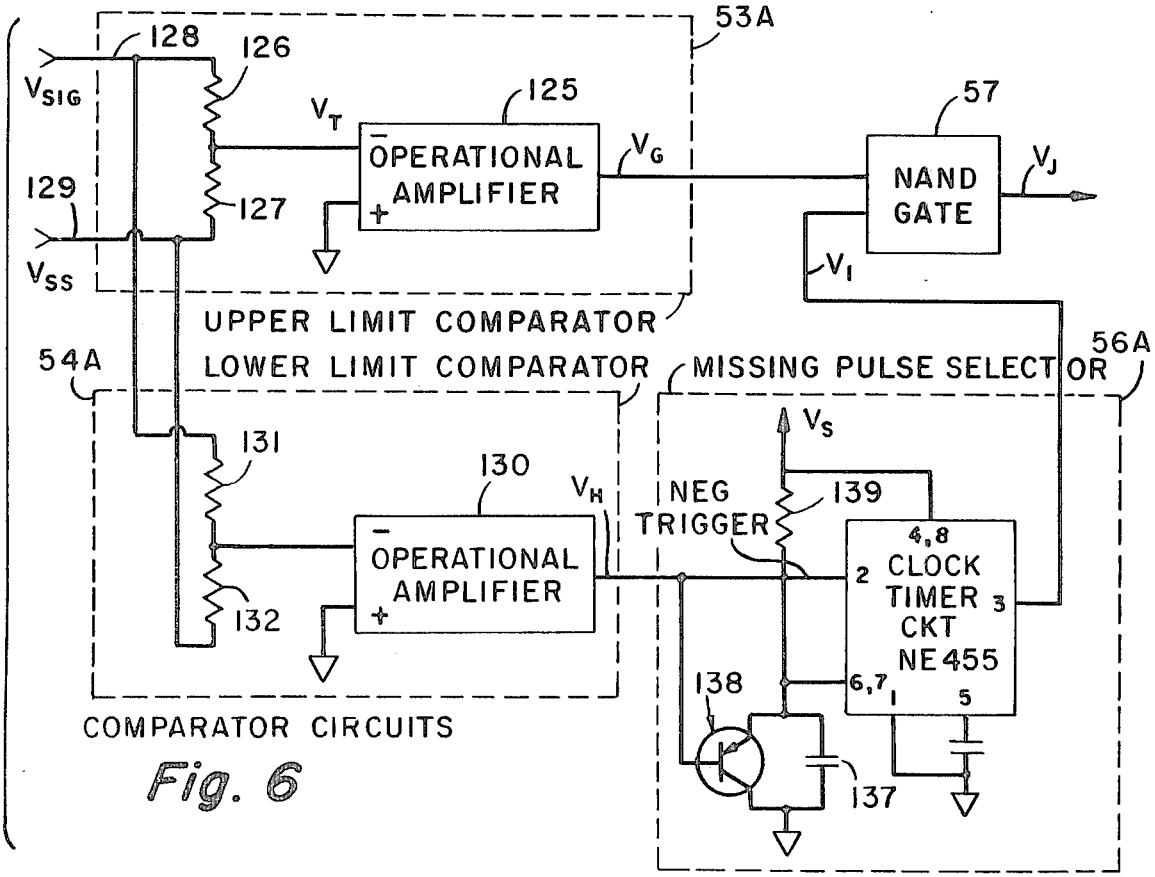
FIG. 6 is a more detailed circuit diagram, partly in functional block form, of the level detection circuitry of FIG. 4.

Referring now to FIG. 6, the circuitry for the upper limit comparator is shown within the dashed block 53A; the circuitry for the lower limit comparator is shown within the dashed block 54A; and the circuitry for the missing pulse detector is shown within the dashed block 56A. The upper limit comparator includes an operational amplifier 125 having its positive input terminal connected to common and its negative input terminal connected to the junction between first and second resistors 126, 127. The other terminal of resistor 126 is connected to the output of the adjustable gain amplifier 50 via lead 128; and the other terminal of resistor 127 is connected to the output of the sample and hold circuit via lead 129.

Similarly, the lower limit comparator includes an operational amplifier 130 having its positive input connected to common and its negative input connected at a junction between resistors 131 and 132. The other terminal of resistor 131 is connected to the single input, and the other terminal of resistor 132 is connected to the output of the sample and hold circuit.

The output of the sample and hold circuit is a negative voltage signal, $V_{SS}$, the magnitude of which is representative of the steady state response of the unit being tested, as explained above. The output signal from the adjustable gain amplifier 50 is a positive signal, $V_{SIG}$. Hence, the two signals are added algebraically at the negative inputs of the amplifiers 125, 130 respectively. This is a signal designated $V_{SIG}-V_{SS}$. The value of the resistor 126 is 1.256 greater than the value of resistor 127. Hence, when the magnitude $V_{SIG}$ is more than 2 dB greater than the magnitude of $V_{SS}$, the output of the amplifier 125 is a logic 0. When $V_{SIG}$ is less than 2 dB greater than $V_{SS}$, the output of amplifier 125 is a logic 1. This signal is seen on line L3 of the timing diagram of FIG. 7 and designated $V_G$. Resistor 132 is 1.256 greater than resistor 131, and a change from logic 0 to logic 1 occurs when $V_{SIG}$ goes 2 db below $V_{SS}$, shown on line L4, as $V_H$.

Figure 7:
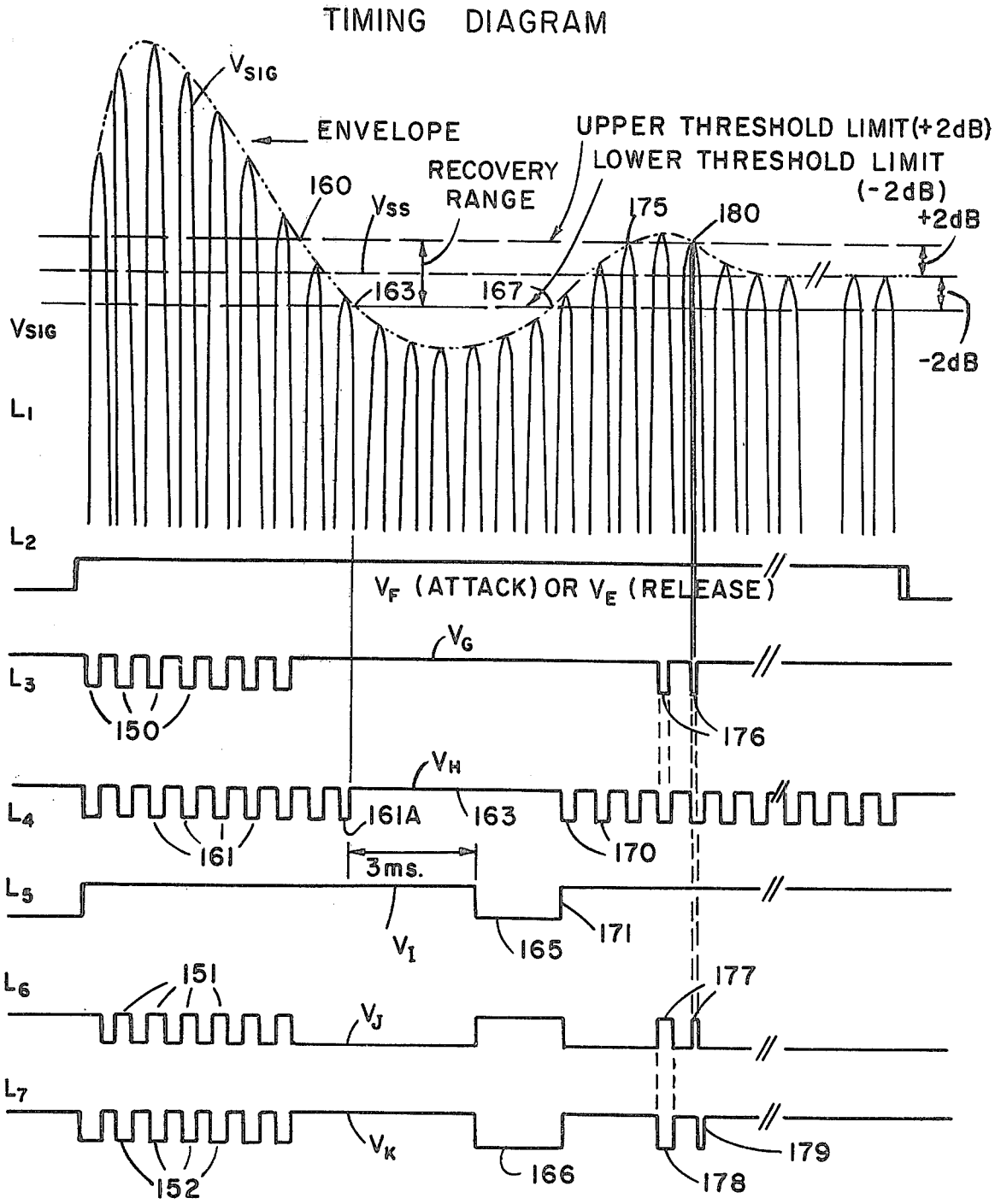
FIG. 7 is an idealized timing diagram showing various voltage waveforms of the circuitry in FIGS. 4 and 6 during the measurement of an attack time for a hearing aid.

The missing pulse detector includes a timer circuit 135 which also may be a conventional 455 timer having the pins connected as illustrated and including a capacitor 137 and resistor 138 which, when connected as shown, convert the timer into a missing pulse detector. That is, an input pulse on lead 2 will cause an output pulse on lead 3 for a predetermined time. The length of the output pulse is determined by the value of a resistor 139 and the capacitor 137. The input pulse also causes the transistor 138 to conduct, thereby discharging the capacitor 137 and re-setting the timer. If an input pulse (negative edge) occurs prior to the time the timer has timed out, it will be reset, and the output signal (designated $V_I$ and seen on line L5 of FIG. 7) remains a constant level. The output signal of the lower limit comparator is designated $V_H$ in FIGS. 6 and 7 and seen on line L4 of FIG. 7. The output signals of operational amplifier 125 ($V_G$) and the missing pulse detector 56 ($V_I$) are fed to the NAND gate 57 of FIG. 4, so that the output of the gate 57 is a logic 1 level in response to either: (a) the output of amplifier 125 being a logic 0, or (b) the output of the timer 135 being a logic 0. This signal is designated $V_J$ and is shown at line L6 of the timing diagram of FIG. 7. Line L7 of FIG. 7 designates a voltage $V_K$ which is the output of one of the NAND gates 59, 60 of FIG. 4, depending upon the position of the function switch 16A. The other input of the NAND gates 59, 60 is $V_F$ (that is, the output of monostable 74) and $V_E$ (the output of monostable 73) as indicated in FIG. 4. The timing diagram of FIG. 7 illustrates the measurement of attack time, so for this purpose, the function switch is in the attack mode, and the input to NAND gate 59 is the ouput of the monostable circuit 74, designated $V_F$ as seen on line L2 of FIG. 7.

OPERATION

With the test unit placed in the chamber 12, the function switch 16 is set to either the attack or the release mode. Assuming that it is set to the attack mode (for the timing illustrated in FIG. 7), when the START switch 17 is actuated, the latch flip flop 67 of FIG. 4 is set, and its output triggers the monostable circuit 68. The output of the monostable circuit 68, when it returns to a relatively high level triggers the first monostable circuit 69 in the timing chain generator means comprising monostable circuits 69–74. From the timing chain signals, the circuitry of FIG. 3 generates the test tone signal shown in FIG. 2 and described above. At time C of FIG. 2, the test tone signal increases in magnitude to the level 42 so as to generate a sound pressure wave of 80 dB SPL. At time D, after the response of the test unit has settled to a steady state value, the output of monostable circuit 72 is coupled through the function switch 16B (set in the ATTACK mode) to line 116 to actuate the sample and hold circuit 52 to store a signal representative of the response of the hearing aid under test 13 at the relatively high test tone level. This signal is stored in the sample and hold circuit 52, and it is fed as signal $V_{SS}$ to the upper limit comparator 53 and the lower limit comparator 54 (see line 129 in FIG. 6). By virtue of selecting the values for resistors 126, 127 and 131, 132 as described above, the upper threshold limit and lower threshold limit for the comparators are established, as indicated diagrammatically by the corresponding voltage levels in line L1 of FIG. 7. It will be recalled that these values define the recovery range (in this case, for measuring attack time) and they are 2 dB above and 2 dB below the steady state response $V_{SS}$ for the unit being tested. At this time, the BCD counters 80–82 are reset as a result of the output of monostable circuit 68 coupled through the OR gate 77.

When the timing chain generates the initiation signal $V_F$(during an attack time measurement) the clock pulse generator 85 is enabled, and it transmits pulses to the input of the lowest significant digit in the measurement—namely, that which is stored in counter 80. At the same time, the voltage $V_F$ (line L2 in FIG. 7) enables the NAND gate 59 of FIG. 4. Prior to this time, the gain of the adjustable gain amplifier had been adjusted as described in connection with the circuitry of FIG. 5; and its output is coupled along line 128 both to the upper limit comparator 53 and the lower limit comparator 54. When the output of the amplifier 50 is greater than the upper threshold limit (that is, more than 2 dB greater than the value being stored in the sample and hold circuit 52), the operational amplifier 125 of FIG. 6 generates the signal $V_G$ on line L3 of FIG. 7. That is, a logic 0 is generated for each time the instantaneous value of the tone signal exceeds the upper threshold level. These are the pulses indicated at 150 on line L3. Each time one of the pulses goes to logic 0, the output of the NAND gate 57 is a logic 1, as seen on line L6 of FIG. 7, and indicated by the pulses 151. Each of these pulses, in turn, is inverted in the NAND gate 59 (which is enabled by the voltage $V_F$ on line L2) and causes a corresponding 0 logic level signal $V_K$ (the ENABLE signal) on line L7 (pulses 152) which enables the display registers 63–65 to be updated according to the contents of the registers 80–82. It will be recalled that these registers accumulate pulses from the clock pulse generator 85 such that the cumulative count is representative of elapsed time from which the clock pulse generator 85 was enabled (in this case, it was enabled at time F in FIG. 2). It will also be recalled that the display circuits 63–65 are enabled by a logic 0 or low voltage state—namely, the pulses 152 on line L7 of FIG. 7. Each time one of the pulses 152 occurs, it causes the contents of the counters 80–82 which have accumulated to be transferred to the corresponding register for decoding and display.

When the envelope of the output signal $V_{SIG}$ from the adjustable gain amplifier 50 diminishes below the upper threshold limit, such as at the point 160 in line L1 of FIG. 7, the output pulses from the upper limit comparator terminate. The lower limit comparator 54, on the other hand continues to generate pulses 161 on line L4 of FIG. 7 until the envelope reaches the point 162 of the graph on line L1 of FIG. 7. Each of the pulses 161 of the lower limit comparator 54 effects a reset of the missing pulse detector 56. After the last pulse 161A in the chain of pulses 161 resets the missing pulse detector and it times out (its time being represented graphically by the arrow 163 on line L5), its output signal goes low at 165. This signal is coupled through the NAND gate 57 and the NAND gate 59 to produce a low level 166 on the enable line for the registers. The registers are updated continuously thereafter, as long as the envelope of the signal $V_{SIG}$ remains below the lower threshold limit.

The missing pulse detector provides immunity to false updating by noise signals. As long as the missing pulse detector generates its output signal, the display registers are not updated. However, this pulse length cannot be made too long since it affects measurement accuracy or resolution. A pulse length of 3 ms. has been found to provide noise immunity as well as accuracy.

When the envelope in the illustrated example again exceeds the lower threshold limit by passing through the point 167, the lower limit comparator will again generate a sequence of output pulses 170 to re-trigger the missing pulse detector and the positive edge 171 of the voltage $V_I$ will terminate the updating of the registers. This would also terminate the measurement if the envelope thereafter does not exceed the upper threshold limit. In the illustrated example, however, as can be seen, the envelope exceeds the upper threshold light at 175, and the upper limit comparator 53 again begins to generate pulses designated 176. These pulses, in turn, produce output pulses 177 from the NAND gate 57 which, in turn, produce pulses 178 from the NAND gate 59 for updating the registers. The measurement terminates on the positive going edge 179 on line L7 which corresponds to the point 180 of the graph of line L1 when the envelope falls below the upper threshold limit and thereafter remains within the recovery range.

When measuring release time, the circuitry operates in the manner just described except that the function switch is in the RELEASE position, so the initial sample is taken at time B of FIG. 2 (for a period of 100 milliseconds), and the clock pulse generator 85 is enabled at point E (the output of monostable 73 in the timing change) to commence measurement.

It will be appreciated from the above description that the automatic measuring system is responsive to the individual cycles of the test tone signal rather than to the envelope defined by the peaks of the individual cycles. This has the design advantage that the specifications on the individual amplifiers and circuits need not be as stringent and difficult to achieve as would be required if the envelope were used for measurment rather than the individual tone cycles as indicated.

It will also be appreciated that release time measurements appear within about three seconds after the start button is actuated, and attack time measurements appear in less than five seconds. Further, these measurements are made automatically by the circuitry and appear on the digital display as numerals, without interpretive visual observation and recording by the operator. If the test results are doubted, the test may be repeated simple by re-actuating the start button. Both attack and release times can quickly and easily be measured without requiring a highly skilled operator. In an acoustically noisy environment, a number of readings could be taken and a median measurement value derived from them.

It will be appreciated by those skilled in the art that the measuring system is responsive to an electrical signal (the output of the hearing aid being converted to such by a coupler and microphone) and that what is being measured is the response of the electronic portion of the hearing aid, not the acoustical portion, so that the measuring system may be used on any electronic circuits having feedback control of gain or output (compression circuits). In such a case, an electrical test signal as shown in FIG. 2 and described above is fed to the input of the test circuit, and the output may be taken directly. Delays for the loudspeaker, etc., will, of course, be eliminated.

Having thus described in detail a preferred embodiment of the invention, persons skilled in the art will be able to modify certain of the structure which has been disclosed and to substitute equivalent elements for those described while continuing to practice the principle of the invention; and it is, therefore, intended that all such modifications and substitutions be covered as they are embraced within the spirit and scope of the appended claims.

I claim:

1. Apparatus for measuring the response time of an acoustical device in a sound pressure chamber having a loud-speaker, comprising test tone signal generator means for exciting said loudspeaker with a sinusoidal signal peridically switched between a first amplitude and a second amplitude and thereby creating a corresponding acoustical test tone signal having first and second levels of intensity in said chamber; storage circuit means responsive to the output of said device for storing a signal representative of the steady state response of said device to said acoustical test tone signal at one of said levels of intensity; first circuit means receiving the output response of said device for generating an enable signal when said response is outside a predetermined recovery range relative to said stored signal; time measuring circuit means for measuring cumulative time lapse; timing circuit means for generating an initiation signal in timed relation with a change of said intensity to said one level of intensity from the other level, said initiation signal enabling said time measuring circuit means to commence measuring time lapse, said enable signal of said first circuit means terminating said measurement by said timing circuit means when said response signal is within said recovery range.

2. The apparatus of claim 1 wherein said first circuit means comprises comparator circuit means responsive to said stored signal representative of the steady state response of said device at said one level of intensity and responsive to the output of said device after said representative signal is stored for comparing said output signal with said stored signal and generating said enable signal for terminating the measurement of cumulative time lapse by said time measuring circuit means when said response signal comes within said recovery range.

3. The apparatus of claim 2 wherein said comparator circuit means comprises an upper limit comparator circuit means responsive to said stored signal and to said output response signal of said device for generating a first signal when said response is greater than said stored signal by a first predetermined amount; lower limit comparator circuit means responsive to said stored signal and to said output response signal of said device for generating a second signal when the magnitude of said response signal is less than the magnitude of said stored signal by a second predetermined amount, said first and second predetermined amounts defining said recovery range; and logic circuit means responsive to said first and second signal for generating said enable signal and transmitting the same to said timing circuit means when both said upper limit comparator circuit means and said lower limit comparator circuit mans indicate that said response signal is within said recovery range.

4. The apparatus of claim 1 wherein said first amplitude is a relatively low amplitude and said second amplitude is a relatively high amplitude, whereby said apparatus measures the attack time of said acoustical device.

5. The apparatus of claim 1 wherein said first amplitude is a relatively high amplitude and said second amplitude is a relatively low amplitude, wherey said apparatus measures the release time of said acoustical device.

6. The apparatus of claim 1 wherein said time measuring circuit means comprises clock pulse generator circuit means for generating clock pulses of a known repetition rate; counter circuit means for accumulating said clock pulses; register circuit means receiving the output signals of said counter circuit means, said register circuit means being responsive to said enable signal of said first circuit means to receive the contents of said counter circuit means, whereby said register circuit means is updated each time said response signal is outside said recovery range, said timing circuit means generating said initiation signal and coupling the same to enable said clock pulse generator when said level changes to said one level from said other level.

7. The apparatus of claim 6 wherein said response signal is a sinusoidal signal of the same frequency as said test tone signal, said upper limit comparator circuit means being responsive each time the magnitude of said response signal exceeds the magnitude of said stored signal by said predetermined amount to update said register circuit means.

8. The apparatus of claim 7 wherein said lower limit comparator circuit means is responsive to each cycle of said response signal for generating a signal when the magnitude of said response signal exceeds a lower limit threshold set at a predetermined amount beneath said stored signal, and further including detector circuit means for generating a signal when the output of said lower limit comparator circuit means does not exceed said lower threshold, the output of said detector circuit means updating said register circuit means to receive the contents of said counter circuit means.

9. The apparatus of claim 8 further comprising visual display means responsive to the output signals of said register circuit means for displaying indicia representative of the cumulative count stored in said register circuit means.

10. The apparatus of claim 1 further comprising adjustable gain amplifier circuit means including an amplifier; comparator circuit means responsive to the output signal of said amplifier and a reference signal of predetermined magnitude for adjusting the gain of said amplifier when the output signal of said amplifier exceeds said predetermined reference signal; and logic circuit means including a timer circuit for permitting said comparator circuit means to adjust the gain of said amplifier circuit after a start signal and for disabling said gain adjustment prior to storage of said signal representative of said steady state response by said storage circuit means, the output signal of said adjustable gain amplifier circuit means feeding said first circuit means.

11. The apparatus of claim 10 wherein said gain adjustment circuit means further comprises a counter circuit means, said logic circuit means coupling the output of said timer circuit to periodically advance the state of said counter circuit means; said adjustable gain amplifier means including at least first and second switch means for coupling resistive means in circuit with said amplifier means for changing the gain thereof, said switch means being responsive to the output states of said counter circuit means; said timer circuit advancing the state of said counter circuit means periodically, and being disabled prior to the time said storage circuit means stores said signal representative of the steady state response of said device under test.

12. Apparatus for measuring the response time of an acoustical device comprising: a sound pressure chamber for housing said device; a loudspeaker in said chamber; test tone signal generator means for exciting said loudspeaker with a sinusoidal signal periodically switched between a first amplitude and a second amplitude for generating a corresponding acoustical test tone signal having at least first and second levels of intensity in said chamber; storage circuit means responsive to the output of said device for storing a signal representative of the steady state response of said device to said acoustical test tone signal at said first level of intensity of said test tone signal; comparator circuit means responsive to said stored signal of said storage circuit means and to the output response of said device during an amplitude cycle of said test tone signal for generating an enable signal when said response is outside a predetermined recovery range relative to said stored signal; time measuring circuit means including a clock pulse generator responsive to an initiation signal for accumulating time pulses from said clock pulse generator; timing circuit means for generating said initiation signal to said time measuring circuit means in timed relation with a change of said intensity from said second level to said first level after said storage circuit means has stored said signal representative of said steady state response; and register circuit means responsive to said enable signal for storing the contents of said time measuring circuit means when said enable signal is generated, the contents of said register circuit means being representative of the cumulative time from said initiation signal until said response signal is maintained within said recovery range.

13. The apparatus of claim 12 further comprising visual display means responsive to the output signals of said register circuit means for generating visual indicia representative of the contents thereof.

14. The apparatus of claim 13 further comprising a start switch actuatable by an operator; timing chain generator means responsive to the actuation of said start switch for generating a series of sequentially occurring timing signals; function switch means actuatable by an operator for determining the measurment mode of said apparatus, said storage circuit means being responsive to the position of said function switch means, said function switch means being selectable to connect a predetermined timing signal from said timing chain generator means to said storage signal means for storing said steady state reference signal, said function switch means being connected in circuit with the output of said comparator circuit means and said timing chain generator means for generating said enable signal for said register circuit means at a predetermined measurement time in said timing chain.

15. The apparatus of claim 14 further comprising adjustable gain circuit means including an amplifier; a plurality of impedance means; a plurality of switch means, one associated with each of said impedance means for selectively connecting the same in circuit with an amplifier means for changing the gain thereof; counter circuit means including a timer circuit and responsive to the actuation of said start switch for periodically changing the state of said switch means for controlling the gain of said amplifier; and comparator circuit means responsive to the output signal of said amplifier and a predetermined reference signal for enabling said counter circuit means to reduce the gain of said amplifier when the output thereof is above said reference signal.

16. A method of automatically measuring the response time of an acoustical device having automatic gain control comprising exciting said device with an acoustical test tone, having first and second levels of intensity; sampling the response of said device during said first excitation of said device at said first level after said response has reached a steady state value; storing an electrical signal representative of said steady state response of said device at said first level; generating a transient electrical signal representative of said response; starting a timing circuit at the commencement of said subsequent change of intensity; and electronically measuring the lapsed time from the start of said timing circuit until said response remains within a predetermined recovery range relative to said stored electrical signal.

17. The method of claim 16 wherein said step of measuring comprises initiating an oscillator at the time of said subsequent change of intensity; counting the output signals of said oscillator; and generating a cumulative digital signal representative of the counts of said oscillator signal each time said response is outside of said recovery range.

18. The method of claim 16 further comprising the steps of coupling the output of said device through an adjustable gain amplifier; and adjusting the gain of said amplifier so that its output is within a predetermined range prior to said step of sampling, and while coupling said test tone signal at said first level of intensity to said device.

19. Apparatus for measuring the response time of an electrical circuit having automatic gain or volume control comprising: drive circuit means for exciting said circuit with a sinusoidal test signal periodically switched between a first amplitude and a second amplitude; storage circuit means responsive to the output of said device and to a first timing signal for storing a signal representative of the steady state response of said device to said acoustical test tone signal at a first time when said test signal is at said first level of intensity; comparator circuit means responsive to said stored signal of said storage circuit means and to the output signal of said device excited by said test signal at said first level for generating an enable signal when said output signal of said device is outside a predetermined recovery range relative to said stored signal; time measuring circuit means including a clock pulse generator responsive to a second timing signal for accumulating time pulses from said clock pulse generator; timing circuit means for generating said first timing signal to said storage circuit means and for thereafter generating said second timing signal to said time measuring circuit means in timed relation with a change of said intensity from said second level to said first level; and register circuit means responsive to said enable signal of said comparator circuit means for storing the contents of said time measuring circuit means when said enable signal is generated, the contents of said register circuit means being representative of the cumulative time from said second timing signal until said output signal of said device is maintained within said recovery range.

20. The apparatus of claim 19 further comprising visual display means responsive to the output signals of said register circuit means for generating visual indicia representative of the contents thereof.

21. The apparatus of claim 20 wherein said timing circuit means comprises timing chain generator means responsive to the actuation of a start switch for generating a series of sequentially occurring timing signals including said first and second timing signals; a start switch actuatable by an operator; function switch means actuatable by an operator for determining the measurement mode of said apparatus, said storage circuit means being responsive to the position of said function switch means, said function switch means being selectable to connect a predetermined timing signal to comprise said first timing signal for storing said steady state reference signal, said function switch means being connected in circuit with the output of said comparator circuit means and said timing chain generator means for generating said enable signal for said register circuit means in response to said second timing signal in said timing chain.

22. The apparatus of claim 21 further comprising adjustable gain circuit means including an amplifier; a plurality of impedance means; a plurality of switch means, one associated with each of said impedance means for selectively connecting the same in circuit with an amplifier means for changing the gain thereof; counter circuit means including a timer circuit and responsive to the actuation of said start switch for periodically changing the state of said switch means for controlling the gain of said amplifier; and comparator circuit means responsive to the output signal of said amplifier and a predetermined reference signal for enabling said counter circuit means to reduce the gain of said amplifier when the output thereof is above said reference signal.

* * * * *